United States Patent [19]

Obayashi et al.

[11] 3,971,282

[45] July 27, 1976

[54] ELECTRONIC MUSICAL INSTRUMENT CAPABLE OF TRANSPOSITION

[75] Inventors: Nobuharu Obayashi, Shizuoka; Tetsuzi Sakashita, Hamamatsu, both of Japan

[73] Assignee: Kabushiki Kaisha Kawai Gakki Seisakusho, Hamamatsu, Japan

[22] Filed: Jan. 27, 1975

[21] Appl. No.: 544,664

Related U.S. Application Data

[63] Continuation-in-part of Ser. No. 352,627, April 19, 1973, Pat. No. 3,877,337.

[30] Foreign Application Priority Data

Apr. 20, 1972 Japan ..... 47-39103

[52] U.S. Cl. ..... 84/1.01; 84/1.24; 84/445

[51] Int. Cl.[2] ..... G10H 1/00; G10H 5/02

[58] Field of Search ..... 84/1.01, 1.24, 445–449

[56] References Cited

UNITED STATES PATENTS

| | | | |
|---|---|---|---|
| 3,610,800 | 10/1971 | Deutsch | 84/1.01 |
| 3,674,907 | 7/1972 | Derry | 84/1.01 |
| 3,697,661 | 10/1972 | Deutsch | 84/1.01 |
| 3,824,325 | 7/1974 | Obayashi et al. | 84/1.01 |
| 3,836,909 | 9/1974 | Cockerell | 84/1.01 X |
| 3,890,871 | 6/1975 | Oberheim | 84/1.01 |
| 3,910,149 | 10/1975 | Obayashi | 84/1.01 |

*Primary Examiner*—L. T. Hix
*Assistant Examiner*—Stanley J. Witkowski
*Attorney, Agent, or Firm*—Haseltine, Lake & Waters

[57] ABSTRACT

An electronic musical instrument capable of transposition has a high frequency oscillator provided on its output side with an octave frequency divider comprising twelve counter circuits to generate twelve tone signals based on a twelve tone tempered scale. These tone signals are respectively frequency-divided by respective pluralities of counter circuits to obtain a plurality of octave tone signals. An oscillator for transposition comprising a plurality of counter circuits is provided and the output terminals of these counter circuits are selectively connected to an input terminal of the octave frequency divider such that the oscillation frequency generated from the high frequency oscillator is added to the oscillation frequency generated from the transposition oscillation to produce an input frequency for the octave frequency divider. A frequency divider is provided at the output of the oscillator.

1 Claim, 4 Drawing Figures

ELECTRONIC MUSICAL INSTRUMENT CAPABLE OF TRANSPOSITION

RELATED APPLICATION

This application is a continuation-in-part of application Ser. No. 352,627, filed Apr. 19, 1973, and now U.S. Pat. No. 3,877,337.

FIELD OF THE INVENTION

This invention relates to improvements in electronic musical instrument capable of transposition as disclosed in our earlier filed copending application Ser. No. 352,627 now issued as U.S. Pat. No. 3,877,337.

BACKGROUND

In an ordinary keyed instrument, natural keys are disposed for natural tones and chromatic keys are disposed for their derivative tones. Accordingly, when flat families or sharp families are played in this kind of instrument, transposed tones require the use of chromatic keys. For example, C, D, E, F, G, A, B, C in the case of C major are played by pressing natural keys. However, D major begins with the D tone. Accordingly, natural keys and chromatic keys must be pressed. Thus, the operation of chromatic keys is required for transposition and this applies also to the case of all electronic musical instruments. Thus, playing with transposition is very difficult for a beginner.

SUMMARY OF THE INVENTION

The present invention relates to an electronic musical instrument which, in view of the foregoing fact, is so designed that sharp families and flat families can be played by using natural keys only in a manner similar to the case of C major, through shifting of frequencies of sound sources associated with and corresponding to the respective keys, without using chromatic keys, and such that any music can be readily played by means of a switch.

The instrument is characterized by the following: in an electronic musical instrument capable of transposition a high frequency oscillator is provided on its output side with an octave frequency divider comprising twelve counter circuits to generate twelve tone signals based on a twelve tempered scale. These tone signals are respectively frequency divided by respective pluralities of counter circuits to obtain a plurality of octave tone signals. The instrument is characterized in that an oscillator for transportation comprising a plurality of counter circuits is provided, and the output terminals of these counter circuits are selectively connected to the input terminal for the octave frequency divider such that the oscillation frequency generated from the high frequency oscillator is added to the oscillation frequency generated from the transposition oscillator so as to produce an input frequency for the octave frequency divider.

BRIEF DESCRIPTION OF THE DRAWING

Examples of this invention will next be explained with reference to the accompanying drawings in which.

DETAILED DESCRIPTION

The contents of application Ser. No. 352,627 (U.S. Pat. No. 3,877,337) are embodied herein as though reproduced in entirety.

Figure 1:
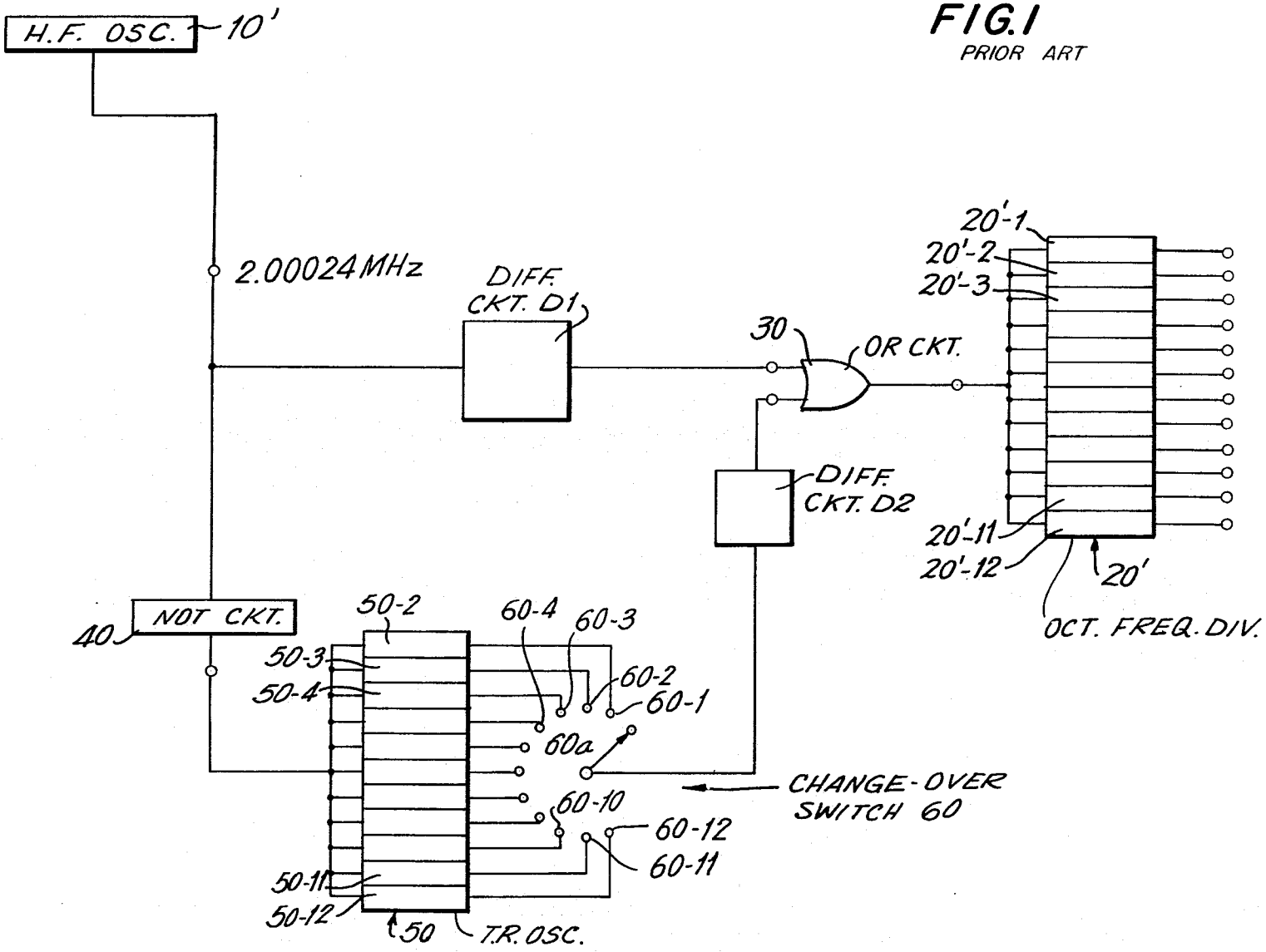
FIG. 1 PRIOR ART
FIG. 1 is a block diagram of one example of this invention.

As shown in FIG. 1 of our prior application, C, D, E, F, G, A, B and C in the case of C major are played by pressing the natural keys K1, K3, K5, K6, K8, K10 and K12. However, in the case of D major, this begins with the D tone. Accordingly, the natural keys K3, K5, chromatic key K7, natural keys K8, K10, and K12, chromatic key K14 and natural key K15 must be employed. Thus, the operation of chromatic keys is required for the transposition and this applies to the case of all electronic musical instruments. Thus, playing with transposition can be very difficult for the beginner.

Figure 2:
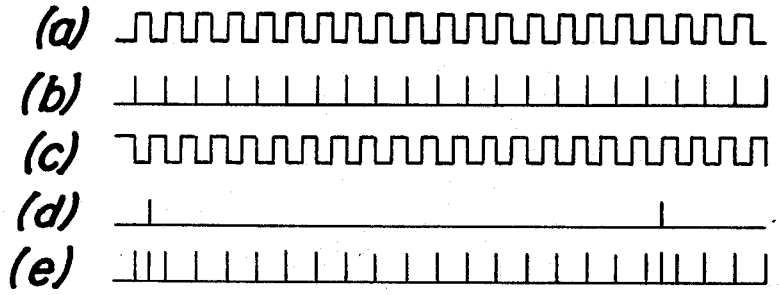
FIG. 2 is a diagram showing a wave form at each portion thereof.

As for systems employing an octave frequency divider, there are two such systems. FIG. 2 of our prior application shows one system with octave frequency divider 20 which comprises twelve counter circuits (20-1) . . . (20-12) connected in series with one another. The frequency dividing ratio of each thereof is 196/185. If it is assumed that a frequency of 8372.02 Hz is generated by the first counter circuit (20-1), the oscillation frequency fm of a high frequency oscillator 10 connected to the input terminal of the octave frequency divider 20 becomes 196/185 times said frequency, that is, 8869.84 Hz. Thus, the oscillation frequencies obtained at output terminals (20-1*a*) . . . (20-12*a*) of the counter circuits (20-1) . . . (20-12) become those shown in FIG. 2 of the prior application. The tone signals of the respective frequencies are as shown in parentheses. Though not illustrated, these oscillation frequencies are each further frequency divided by each of a respective plurality of counter circuits, for example, into 7 stages if it is intended to cover 7 octaves of a whole piano.

Figure 3:
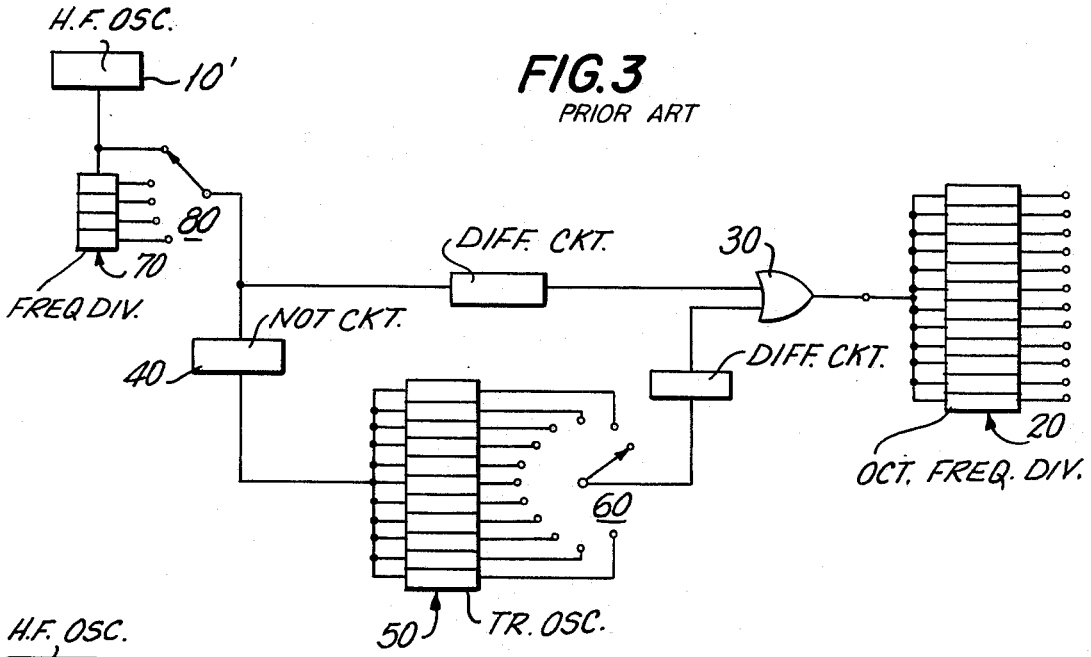
FIG. 3 PRIOR ART
FIGS. 3 and 4 are each a block diagram showing another example of this invention.

FIG. 3 of our prior application shows the other system of octave frequency divider 20'. It comprises twelve counter circuits (20'-1) . . . (12'-12) connected in parallel with one another to a common high frequency oscillator 10'. The frequency dividing ratios thereof are 1/239, 1/253 . . . 1/451, respectively, as shown in FIG. 3. If it is assumed that 8369.21 Hz is generated by the first counter circuit (20'-1), the oscillation frequency fm' of the high frequency oscillator 10' is 239 times said frequency, that is, 2.00024 MHz. Thus, the oscillation frequencies obtained at output terminals (20'-1*a*) . . . (20'12*a*) of the counter circuits (20'-1) . . . (20'-12) become nearly equal to those in the case shown in FIG. 2 of U.S. Pat. No. 3,877,337.

Figure 4:
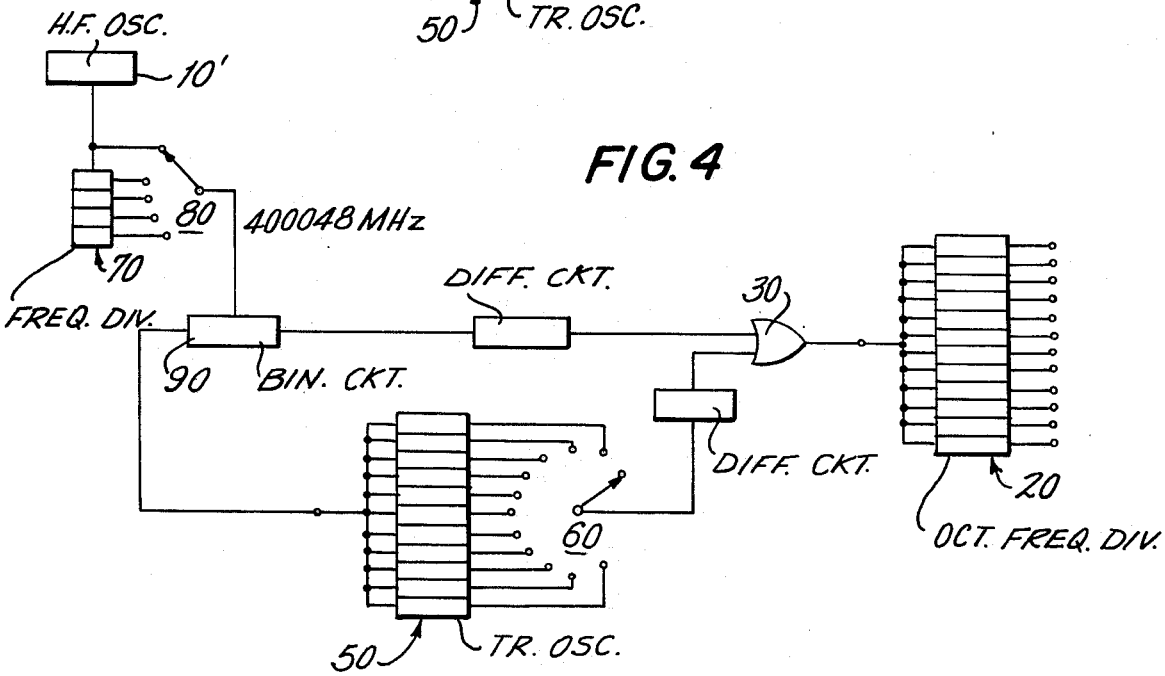

FIG. 1 of the present application corresponds to FIG. 4 in the prior application. An output terminal of a high frequency oscillator 10' is connected to an octave frequency divider 20' through an OR circuit 30. The output terminal is also connected through a NOT circuit 40 (i.e., a circuit which changes a 0 to a 1 and vice versa) to an oscillator 50, for transposition, comprising a plurality of counter circuits (50-2) . . . (50-12). It is so arranged that output terminals of the transposition oscillator 50 are selectively connected to the OR circuit 30 through a change-over switch 60. The change-over switch 60 comprises a stationary contact (60-1) positioned at a zero position and not connected to the transposition oscillation 50, a plurality of stationary contacts (60-2) . . . (60-12) connected to the respective counter circuits (50-2) . . . (50-12), and a movable contact 60*a* connected to the OR circuit 30.

The oscillation frequency of the high frequency oscillator 10' is 2.00024 MHz and the wave form thereof is as shown in FIG. 2*a*. This wave form is then differentiated by differentiation circuit D1 (FIG. 1) into the wave form shown in FIG. 2*b* and then is applied to the octave frequency divider 20' through the OR circuit. 30. Also, the output wave form shown in FIG. 2*a* of the high frequency oscillator 10' is inverted by the NOT circuit 40 as shown in FIG. 2*c* and is differentiated by a differentiation circuit D2 (FIG. 1) as shown in FIG. 2*d* and is applied to the octave frequency divider 20' through the OR circuit 30.

The oscillation frequencies generated at the respective counter circuits (50-2) . . . (50-12) of the transposition oscillator 50 are shown in Table 1 below.

TABLE 1

| | Counter circuit number | Oscillation frequency MHz | Total frequency MHz | Tone signal |
|---|---|---|---|---|
| 1 | | 0 | 2.00024 | C |
| 2 | 50 – 2 | 0.11717 | 2.11741 | C#(D♭) |
| 3 | 50 – 3 | 0.24055 | 2.24079 | D |
| 4 | 50 – 4 | 0.37661 | 2.37685 | D# (E♭) |
| 5 | 50 – 5 | 0.51889 | 2.51913 | E |
| 6 | 50 – 6 | 0.66953 | 2.66977 | F |
| 7 | 50 – 7 | 0.82875 | 2.82899 | F# (G♭) |
| 8 | 50 – 8 | 0.99593 | 2.99617 | G |
| 9 | 50 – 9 | 1.17169 | 3.17192 | G# (A♭) |
| 10 | 50 – 10 | 1.36418 | 3.36442 | A |
| 11 | 50 – 11 | 1.56504 | 3.56528 | A# (B♭) |
| 12 | 50 – 12 | 1.77427 | 3.77451 | B |

As is clear from Table 1, the dividing ratios of counter circuits (50-2) . . . (50-12) are as follows:

$$50-2 \quad \frac{2.00024}{0.11717}$$

$$50-3 \quad \frac{2.00024}{0.24055}$$

$$50-4 \quad \frac{2.00024}{0.37661}$$

$$50-5 \quad \frac{2.00024}{0.51889} \ldots$$

When the movable contact 60a is set to the stationary contact (60-1), the oscillation 60*a* 2.00024 MHz itself of the high frequency oscillator 10' becomes an input for the octave frequency divider 20', and output frequencies as shown in Table 2, column (I) are obtained at its respective output terminals. The tone signals corresponding to the respective frequencies are as shown on the right hand side thereof. This is C major, and playing can be carried out by using natural keys only.

If, next, the movable contact 60*a* is connected to the stationary contact (60-2) octave frequency divider 20' through the OR circuit 30 is added to the oscillation frequency 2.00024 MHz of the high frequency oscillator 10'. This condition is such that the wave form (FIG. 2*c*) inverted by the NOT circuit 40 is used as the input for the transposition oscillator 50, and the output thereof is differentiated (FIG. 2*d*) and is properly interposed through the OR circuit 30 in the oscillation frequency of the high frequency oscillator 10' (FIG. 2*e*).

Thus, the input frequency for the octave frequency divider 20' becomes 2.11741 MHz and, accordingly, the output frequencies of the octave frequency divider 20' become those shown in Table 2, column (II). The tone signals are as shown on the right hand side thereof. This is a C # and shows that it is transposed to the higher side by one interval. Accordingly, playing of C # major can be easily effected by operating only natural keys in almost the same manner as in the case of C major, without using chromatic keys.

If, next, the movable contact 60*a* is connected to the stationary contact (60-3), the oscillation frequency 0.24055 MHz of the counter circuit (50-3) is added to the oscillation frequency 2.00024 MHz of the high frequency oscillator 10' and it becomes 2.24079 MHz. The respective oscillation frequencies of the octave frequency divider 20' become those shown in Table 2, column (III), and the tone signal thereof is D and this shows that it is further transposed to the higher side by one interval. Accordingly, playing of D major can be effected by the operation of only natural keys. Thus, any desired transposition can be effected by that the oscillation frequencies of the counter circuits (50-2) . . . (50-12) of the transportation oscillator 50 are selectively added to the oscillation frequency of the high frequency oscillator 10', and thereby the playing of any desired music with sharps or flats becomes possible by using only natural keys.

TABLE 2

| | Counter circuit number of octave frequency divider | (I) C major | | (II) C# major | | (III) D major | |
|---|---|---|---|---|---|---|---|
| | | Output frequency Hz | Tone signal | Output frequency Hz | Tone signal | Output frequency Hz | Tone signal |
| 1 | 20' – 1 | 8369.21 | C | 8859.46 | C# | 9375.69 | D |
| 2 | 20' – 2 | 7906.09 | B | 8396.21 | C | 8856.88 | C# |
| 3 | 20' – 3 | 7463.58 | A# | 7900.78 | B | 8361.16 | C |
| 4 | 20' – 4 | 7043.10 | A | 7455.67 | A# | 7890.11 | B |
| 5 | 20' – 5 | 6645.32 | G# | 7034.58 | A | 7444.49 | A# |
| 6 | 20' – 6 | 6270.34 | G | 6637.65 | G# | 7024.42 | A |
| 7 | 20' – 7 | 5917.87 | F# | 6264.53 | G | 6629.56 | G# |
| 8 | 20' – 8 | 5587.26 | F | 5914.55 | F# | 6259.19 | G |
| 9 | 20' – 9 | 5277.68 | E | 5586.83 | F | 5912.37 | F# |
| 10 | 20' – 10 | 4975.72 | D# | 5267.19 | E | 5574.10 | F |
| 11 | 20' – 11 | 4695.40 | D | 4970.45 | D# | 5260.07 E | E |
| 12 | 20' – 12 | 4435.12 | C# | 4694.92 | D | 4968.49 | D# |
| | Input frequency | 2.00024 MHz | | 2.11741 MHz | | 2.24079 MHz | |
| | Contact number of change-over switch | 60 – 0 | | 60 – 2 | | 60 – 3 | |

The above is the case where transposition is to the higher side. As shown in FIG. 3, which corresponds to FIG. 6 of U.S. Pat. No. 3,877,377, the high frequency oscillator 10' is provided on its output terminal with frequency divider 70 comprising a plurality of counter circuits and selector switch 80, so that the oscillation frequencies thereof are lowered by steps at each counter circuit. If the output terminals thereof are selectively connected to the OR circuit 30 and the NOT circuit 40 through a change-over switch 80, a transposition to the lower side can be easily effected by selective connection of the changeover switch 80 and selective connection of the change-over switch 60. Additionally, movement of an octave becomes possible in that the frequency dividing ratio of each counter circuit of the frequency divider 70 is designed to be ½. If, under this condition, the oscillation frequency of the high frequency oscillator 10' is made higher by several octaves, movement of an octave either to the higher side or the lower side becomes possible by selective connection of the change-over switch 80. Accordingly, a player can play any octave at a predetermined position, without especially moving his position.

FIG. 4 shows one example of this invention where the NOT circuit in FIGS. 1 and 3 is omitted. The high frequency oscillator 10' is provided on its output side with frequency divider 70 comprising a plurality of counter circuits and change-over switch 80, so that the oscillation frequencies thereof are lowered by steps at each counter circuit. In this case, the oscillation frequency of the high frequency oscillator 10' is doubled to be 4.00048 MHz and this frequency is made to be ½ through a binary circuit 90. At the same time, positive and negative wave forms as shown in FIGS. 2*a* and *c* are taken from the binary circuit 90. Thus, this is slightly different from the case of FIGS. 1 and 3.

The above explanation has been given with reference to the second frequency dividing system of an octave frequency divider, but this is similar also in the case of the first system except only that the oscillation frequencies of the high frequency oscillator 10 and the transposition oscillator 50 become smaller.

Thus, according to this invention, the oscillation frequency of the high frequency oscillator is properly added to any of the oscillation frequencies of the transposition oscillator comprising the plurality of counter circuits so as to produce an input for the octave frequency divider so that, by means of selecting the adding frequency, any desired transposition can be effected. Accordingly, the playing of any desired music with sharps or flats can be effected by a player as long as he can play in C major.

What is claimed is:

1. An electronic musical instrument capable of transposition comprising a high frequency oscillator having an output, a first frequency divider connected to the output of said oscillator, selector switch means connected for selecting the output frequency of the high frequency oscillator or a divided frequency at different outputs of the divider, an octave frequency divider including twelve counter circuits to generate twelve tone signals, a transposition oscillator including a plurality of counter circuits, means to control the addition of the frequency of the output of said high frequency oscillator or said first frequency divider to the frequency of the output of the transposition oscillator to generate an input frequency for the octave frequency divider, said means including a selector switch between the transposition oscillator and said octave frequency divider, first and second differentiation circuits connected respectively to said switch means and to said selector switch, an OR circuit connected to the outputs of the first and second differentiation circuits and to the input of the octave frequency divider, and a binary counter between said switch means and said transposition oscillator and said first differentiation circuit.

* * * * *